US011509030B2

(12) United States Patent
Zhang et al.

(10) Patent No.: US 11,509,030 B2
(45) Date of Patent: Nov. 22, 2022

(54) DIELECTRIC FILTER AND COMMUNICATIONS DEVICE

(71) Applicant: HUAWEI TECHNOLOGIES CO., LTD., Guangdong (CN)

(72) Inventors: Xiaofeng Zhang, Kista (SE); Dan Liang, Shanghai (CN); Zheng Cui, Dongguan (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 15 days.

(21) Appl. No.: 17/244,408

(22) Filed: Apr. 29, 2021

(65) Prior Publication Data

US 2021/0249746 A1 Aug. 12, 2021

Related U.S. Application Data

(63) Continuation of application No. PCT/CN2019/114898, filed on Oct. 31, 2019.

(30) Foreign Application Priority Data

Oct. 31, 2019 (WO) ..... PCT/CN2018/113135

(51) Int. Cl.
*H01P 1/20* (2006.01)
*H01P 1/205* (2006.01)
(Continued)

(52) U.S. Cl.
CPC ..... *H01P 1/2056* (2013.01); *H01P 1/2002* (2013.01); *H01P 1/2084* (2013.01); *H01P 7/04* (2013.01); *H01P 7/10* (2013.01)

(58) Field of Classification Search
CPC ..... H01P 1/20; H01P 1/2002; H01P 1/202; H01P 1/2053; H01P 1/205; H01P 1/2056;
(Continued)

(56) References Cited

U.S. PATENT DOCUMENTS 4,757,284 A 7/1988 Ueno
6,535,079 B1 * 3/2003 Hiroshima ..... H01P 1/2056 333/206
(Continued)

FOREIGN PATENT DOCUMENTS

CN 1138220 A 12/1996
CN 1201271 A 12/1998
(Continued)

OTHER PUBLICATIONS

Kunshan, "The Miniaturization Technology of Capacity-loaded Cavity Filter," University of Electronic Science and Technology of China, Jan. 2014, 2 pages (with English abstract).
(Continued)

*Primary Examiner* — Stephen E. Jones
(74) *Attorney, Agent, or Firm* — Fish & Richardson P.C.

(57) ABSTRACT

This application provides an example dielectric filter and an example communications device. The dielectric filter includes a dielectric block. At least two resonant through holes that are parallel to each other are provided in the dielectric block. The resonant through hole is a stepped hole. The stepped hole includes a large stepped hole and a small stepped hole that are arranged coaxially and that are in communication. The small stepped hole passes through a first surface of the dielectric block. The large stepped hole passes through a second surface of the dielectric block. A stepped surface is formed between the large stepped hole and the small stepped hole. The surfaces of the dielectric block are covered with conductor layers. The conductor layers cover the surfaces of the dielectric block and inner walls of the large stepped hole and the small stepped hole.
(Continued)

A conductor layer of the inner wall of the large stepped hole is short-circuited with a conductor layer of the second surface. A conductor layer of the inner wall of the small stepped hole is short-circuited with a conductor layer of the first surface. A loop gap that does not cover the conductor layers is provided on the stepped surface. The loop gap is arranged around the small stepped hole.

20 Claims, 13 Drawing Sheets

(51) Int. Cl.
*H01P 1/208* (2006.01)
*H01P 7/10* (2006.01)
*H01P 7/04* (2006.01)

(58) Field of Classification Search
CPC .... H01P 1/2084; H01P 1/2088; H01P 1/2136; H01P 7/04; H01P 7/10; H01P 7/065
See application file for complete search history.

(56) References Cited

U.S. PATENT DOCUMENTS

| | | | |
|---|---|---|---|
| 7,075,392 | B2 | 7/2006 | Smith et al. |
| 8,115,569 | B2 | 2/2012 | Lee et al. |
| 2006/0038638 | A1 | 2/2006 | Shinabe |
| 2018/0131059 | A1 | 5/2018 | Brannon et al. |

FOREIGN PATENT DOCUMENTS

| | | | |
|---|---|---|---|
| CN | 1237005 | A | 12/1999 |
| CN | 1372347 | A | 10/2002 |
| CN | 1551405 | A | 12/2004 |
| CN | 2867619 | Y | 2/2007 |
| CN | 201629390 | U | 11/2010 |
| CN | 101908666 | A | 12/2010 |
| CN | 204793134 | U | 11/2015 |
| CN | 110148819 | A | 8/2019 |
| EP | 0664572 | A1 | 7/1995 |
| EP | 2993727 | A1 | 3/2016 |
| JP | H0690104 | A | 3/1994 |
| JP | H07169649 | A | 7/1995 |
| JP | H0837405 | A | 2/1996 |

OTHER PUBLICATIONS

Office Action issued in Chinese Application No. 201980069018.8 dated Jun. 13, 2022, 5 pages.
PCT International Search Report and Written Opinion issued in International Application No. PCT/CN2018/113135 dated Jul. 25, 2019, 17 pages (with English translation).
PCT International Search Report and Written Opinion issued in International Application No. PCT/CN2019/114898 dated Jan. 21, 2020, 17 pages (with English translation).
Office Action issued in Chinese Application No. 201980069018.8 dated Jul. 9, 2021, 16 pages (with English translation).
Extended European Search Report issued in European Application No. 19878299.7 dated Oct. 29, 2021, 11 pages.

* cited by examiner

DIELECTRIC FILTER AND COMMUNICATIONS DEVICE

CROSS-REFERENCE TO RELATED APPLICATIONS

This application is a continuation of International Application No. PCT/CN2019/114898, filed on Oct. 31, 2019, which claims priority to International Patent Application No. PCT/CN2018/113135, filed on Oct. 31, 2018. The disclosures of the aforementioned applications are hereby incorporated by reference in their entireties.

TECHNICAL FIELD

This application relates to the field of wireless communications device technologies and, in particular, to a dielectric filter and a communications device.

BACKGROUND

With the development of wireless communications technologies, a current communications system has increasingly high requirements on reliability and performance of a filter. Because a transverse electromagnetic mode (TEM) dielectric filter has advantages such as a small volume, a low loss, and low costs, the TEM dielectric filter gradually becomes a common form in a miniaturized filter of a communications base station.

FIG. 1 is a schematic structural diagram of a TEM dielectric filter. The TEM dielectric filter includes a dielectric body 01 and a metal shielding cover 02, and the metal shielding cover 02 is combined with the dielectric body 01 in a form of welding. There are a plurality of metalized resonant holes 03 inside the dielectric body 01, all outer surfaces of the dielectric body 01 except an upper surface are covered with a conductor layer, and the upper surface of the dielectric body 01 is provided with a plurality of metal painted sheets 04. An upper end of the metalized resonant hole 03 is connected to the metal painted sheet 04, an open circuit is formed between the metal painted sheet 04 and the conductor layer, and a lower end of the metalized resonant hole 03 is short-circuited with the conductor layer on a lower surface of the dielectric body 01. An input pad 05 and an output pad 06 are further disposed on a front surface of the dielectric body 01, the shielding cover is shielded above the upper surface of the dielectric body 01, and a gap is reserved between the shielding cover and the upper surface of the dielectric body 01. A working principle of the TEM dielectric filter shown in FIG. 1 is as follows: After being input from the input pad 05, an electromagnetic wave signal is transmitted through resonant coupling between the plurality of metalized resonant holes 03 and finally output from the output pad 06. In the series of resonance process, only electromagnetic waves whose frequency components are near a resonant frequency are allowed to pass, thereby implementing a filtering effect of the filter.

In the structure of the TEM dielectric filter shown in FIG. 1, the shielding cover has at least the following two effects: First, the shielding cover can shield an electromagnetic signal. Because the upper surface of the dielectric body 01 is not provided with the conductor layer, the shielding of the shielding cover can prevent the electromagnetic signal from leaking from the upper surface of the dielectric body 01. Second, the shielding cover can also reduce a volume of the filter. The reason is as follows: A height of the metalized resonant hole 03 (also a height of the dielectric body 01) needs to be selected as ¼ of a wavelength corresponding to the resonant frequency so that the metalized resonant hole 03 can resonate near the resonant frequency. The wavelength is inversely proportional to the frequency. Therefore, when a smaller resonant frequency is required, a larger volume of the filter is required. However, to maintain the volume miniaturization of the filter, the resonant frequency of the filter can be lowered by introducing a capacitance. Specifically, because the shielding cover and the metal painted sheet 04 are not in communication, a capacitance may be formed between the shielding cover and the metal painted sheet 04. A larger capacitance indicates a lower resonant frequency. Therefore, the capacitance formed between the shielding cover and the metal painted sheet 04 lowers the resonant frequency, and the volume of the filter may be made smaller.

However, the metal shielding cover 02 is disposed on the TEM dielectric filter shown in FIG. 1, and materials of the shielding cover and the dielectric body 01 are different. Therefore, when welded installation is performed on the filter and another component, due to different thermal expansion coefficients of a plurality of materials, a problem of unstable welding is easily caused. In addition, a gap is reserved between the shielding cover and the upper surface of the dielectric body 01, the gap easily leaks a signal from the upper surface of the dielectric body 01 not covered with the conductor layer, and the leaked signal may be directly output from the output pad 06 without resonant filtering through the metalized resonant hole 03. Therefore, background noise increases. In addition, an external interference signal easily enters the filter from the upper surface of the dielectric body 01 not covered with the conductor layer, and the background noise also increases. Finally, a background noise suppression capability of the filter becomes weak, and a background noise suppression level is only about −60 dB.

SUMMARY

A dielectric filter and a communications device provided in embodiments of this application are intended to resolve problems of unstable welding and excessively high background noise easily occurring in an existing TEM dielectric filter.

To achieve the foregoing objective, the embodiments of this application use the following technical solutions:

According to a first aspect, this application provides a dielectric filter, including a dielectric block. At least two resonant through holes that are parallel to each other are provided in the dielectric block, the resonant through hole is a stepped hole, and the stepped hole includes a stepped large hole and a stepped small hole that are arranged coaxially and that are in communication. The stepped small hole passes through a first surface of the dielectric block, the stepped large hole passes through a second surface of the dielectric block, and a stepped surface is formed between the stepped large hole and the stepped small hole.

The surfaces of the dielectric block are covered with conductor layers, and the conductor layers cover the surfaces of the dielectric block and inner walls of the stepped large hole and the stepped small hole. A conductor layer of the inner wall of the stepped large hole is short-circuited with a conductor layer of the second surface, and a conductor layer of the inner wall of the stepped small hole is short-circuited with a conductor layer of the first surface. A loop gap not covered with the conductor layer is provided on the stepped surface, and the loop gap is arranged around the stepped small hole.

According to the dielectric filter provided in this embodiment of this application, a plurality of resonant through holes that are parallel to each other is provided in the dielectric block, the resonant through hole is a stepped hole, and the stepped hole includes a stepped large hole and a stepped small hole that are arranged coaxially and that are in communication. Both the inner wall of the stepped large hole and the inner wall of the stepped small hole are provided with the conductor layer. After being input into the filter, an electromagnetic wave signal is transmitted through resonant coupling between a plurality of stepped small holes. The loop gap is arranged around the stepped small hole so that an open circuit is formed between the conductor layer of the inner wall of the stepped small hole and the conductor layer of the inner wall of the stepped large hole. Therefore, a capacitance may be formed between the conductor layer of the inner wall of the stepped large hole and the conductor layer of the inner wall of the stepped small hole. The introduced capacitance can lower a resonant frequency of the filter so that a volume of the filter can be made smaller. In addition, a direction of an electric field formed between the conductor layer of the inner wall of the stepped large hole and the conductor layer of the inner wall of the stepped small hole is perpendicular to an axial direction of the resonant through hole. Therefore, a resonant direction between the conductor layer of the inner wall of the stepped large hole and the conductor layer of the inner wall of the stepped small hole is also perpendicular to the axial direction of the resonant through hole so that the electromagnetic signal is not easily leaked from the loop gap. In addition, because all surfaces of the dielectric block are provided with the conductor layer, the conductor layer can effectively shield a signal, to prevent signal energy leakage and interference from an external signal, thereby improving a background noise suppression capability. In this way, the dielectric filter provided in this embodiment of this application can prevent signal leakage and implement miniaturization of the filter, and a shielding cover is omitted to prevent a problem of unstable welding.

In a possible implementation, the dielectric block is further provided with an input via and an output via, and both the input via and the output via are metalized through holes. In this way, a signal can be input and output through the input via and the output via, and because metal conductors of the input via and the output via are both in the holes, signal energy leakage caused by an exposed transmission line can be avoided.

In a possible implementation, an input pad connected to the input via and an output pad connected to the output via are disposed on the first surface. The first surface of the dielectric block may be connected to another electronic component during installation. In this way, the input pad and the output pad are disposed on a same surface of the dielectric block so that both the input pad and the output pad of the dielectric filter are connected to a same device, and input and output signals of the dielectric filter are transmitted to the same device.

In a possible implementation, an input pad connected to the input via and an output pad connected to the output via are disposed on the second surface. The second surface of the dielectric block may be connected to another electronic component during installation. In this way, a position of the pad can be selected according to different installation requirements so that installation of the filter is more diversified.

In a possible implementation, an input pad connected to the input via is disposed on the first surface, and an output pad connected to the output via is disposed on the second surface. Alternatively, an output pad connected to the output via is disposed on the first surface, and an input pad connected to the input via is disposed on the second surface. The input pad and the output pad are disposed on different surfaces of the dielectric block so that the input pad and the output pad of the dielectric filter may be respectively connected to different devices. For example, the input pad may be connected to a circuit board, and the output pad may be connected to an antenna.

In a possible implementation, the filter may be connected to another electronic component by using a pin. Specifically, the pin may be inserted into the input via and the output via so that the pin is electrically connected to a metal layer of inner walls of the input via and the output via.

In a possible implementation, an outer diameter of the loop gap is less than or equal to an inner diameter of the stepped large hole; and an inner diameter of the loop gap is greater than or equal to an inner diameter of the stepped small hole. In this way, the inner diameter and the outer diameter of the loop gap can be made according to an actual requirement so that the loop gap does not exceed a range of the stepped surface, thereby facilitating processing and making.

In a possible implementation, a difference between the outer diameter and the inner diameter of the loop gap may be selected to be less than or equal to 1 millimeter. In this way, it can be ensured that an open circuit is formed between the conductor layer of the inner wall of the stepped small hole and the conductor layer of the inner wall of the stepped large hole, and an area of the loop gap can be made smaller so that signal energy is not easily leaked from the loop gap.

In a possible implementation, at least one coupling hole may be provided between two adjacent resonant through holes. The coupling hole is a metalized through hole. A coupling may be tuned by adjusting an aperture of the coupling hole and adjusting a position of the coupling hole relative to the two resonant through holes.

In a possible implementation, the coupling hole may be arranged in parallel with the resonant through hole. This facilitates coupling between the coupling hole and the resonant through hole.

In a possible implementation, the dielectric filter includes at least three resonant through holes, and the at least three resonant through holes are arranged in a staggered manner. The staggered arrangement means that the three resonant through holes are not arranged in one straight line or means that the three resonant through holes are arranged in triangle. In this way, a length of the dielectric filter can be shortened to meet requirements of different installation scenarios.

According to a second aspect, this application provides a dielectric filter, including a dielectric block. At least two resonant through holes that are parallel to each other are provided in the dielectric block, the resonant through hole is a stepped hole, and the stepped hole includes a stepped hole 1 and a stepped hole 2 that are arranged coaxially and that are in communication. The stepped hole 1 passes through a first surface of the dielectric block, the stepped hole 2 passes through a second surface of the dielectric block, and a first stepped surface is formed between the stepped hole 1 and the stepped hole 2. An aperture of the stepped hole 1 is different from an aperture of the stepped hole 2. The surfaces of the dielectric block are covered with conductor layers, and the conductor layers cover the surfaces of the dielectric block and inner walls of the stepped hole 1 and the stepped hole 2. A conductor layer of the inner wall of the stepped hole 2 is short-circuited with a conductor layer of the second surface, and a conductor layer of the inner wall of the stepped hole 1 is short-circuited with a conductor layer of the first surface. A loop gap not covered with the conductor layer is provided on the first stepped surface.

In a possible implementation, the dielectric block is further provided with an input via and an output via, and both the input via and the output via are metalized through holes.

In a possible implementation, the first surface is provided with an input pad connected to the input via and an output pad connected to the output via.

In a possible implementation, the second surface is provided with an input pad connected to the input via and an output pad connected to the output via.

In a possible implementation, an outer diameter of the loop gap is between the aperture of the stepped hole 1 and the aperture of the stepped hole 2, and an inner diameter of the loop gap is between the aperture of the stepped hole 1 and the aperture of the stepped hole 2. The outer diameter of the loop gap is different from the inner diameter of the loop gap.

In a possible implementation, a difference between the outer diameter and the inner diameter of the loop gap is less than or equal to 1 millimeter.

In a possible implementation, the stepped hole 1 includes a stepped hole 3 and a stepped hole 4 that are arranged coaxially and that are in communication. The stepped hole 3 passes through the first surface of the dielectric block, the stepped hole 4 is in communication with the stepped hole 2, and a second stepped surface is formed between the stepped hole 3 and the stepped hole 4. An aperture of the stepped hole 3 is different from an aperture of the stepped hole 4.

In a possible implementation, a plurality of parallel resonant through holes provided in the dielectric block are dumbbell stepped holes. The stepped large hole is at two ends, the stepped small hole is in the middle, and both an inner wall and an outer wall of the stepped large hole are provided with a conductor layer. A loop gap not covered with the conductor layer is provided on the stepped surface of at least one end of the stepped large hole and the stepped small hole so that a capacitance may be formed between the conductor layer of the inner wall of the stepped large hole and the conductor layer of the inner wall of the stepped small hole. The introduced capacitance can lower a resonant frequency of the filter so that a volume of the filter is made smaller. In addition, a direction of an electric field between the conductor layers is perpendicular to an axial direction of the resonant through hole, shielding and leakage prevention can also be implemented, miniaturization can be implemented, and a shielding cover is omitted to prevent a problem of unstable welding.

In a possible implementation, apertures of the stepped hole 4, the stepped hole 2, and the stepped hole 3 are different, and a plurality of parallel resonant through holes provided in the dielectric block are double-stepped holes. A stepped large hole and a stepped medium hole are at two ends, a stepped small hole is in the middle, and inner walls of the stepped large hole, the stepped small hole, and the stepped medium hole are all provided with a conductor layer. A loop gap not covered with the conductor layer is provided on at least one of the two stepped surfaces so that a capacitance may be formed between the conductor layers of the inner walls of adjacent stepped holes. The introduced capacitance can lower a resonant frequency of the filter so that a volume of the filter is made smaller. In addition, a direction of an electric field between the conductor layers is perpendicular to an axial direction of the resonant through hole, shielding and leakage prevention can also be implemented, miniaturization can be implemented, and a shielding cover is omitted to prevent a problem of unstable welding.

In a possible implementation, the plurality of parallel resonant through holes provided in the dielectric block are double-stepped holes, where the stepped large hole and the stepped small hole are at two ends, the stepped medium hole is in the middle, and inner walls of the stepped large hole, the stepped medium hole, and the stepped small hole are all provided with a conductor layer. A loop gap not covered with the conductor layer is provided on at least one of the two stepped surfaces so that a capacitance may be formed between the conductor layers of the inner walls of adjacent stepped holes. The introduced capacitance can lower a resonant frequency of the filter so that a volume of the filter is made smaller. In addition, a direction of an electric field between the conductor layers is perpendicular to an axial direction of the resonant through hole, shielding and leakage prevention can also be implemented, miniaturization can be implemented, and a shielding cover is omitted to prevent a problem of unstable welding.

In a possible implementation, a plurality of parallel resonant through hole stepped holes provided in the dielectric block are not limited to the double-stepped hole, and both a three-stepped hole and a four-stepped hole are available. A capacitance can be formed between the conductor layers provided that a loop gap not covered with the conductor layer is provided on the at least one stepped surface. The introduced capacitance can lower a resonant frequency of the filter so that a volume of the filter is made smaller. In addition, a direction of an electric field between the conductor layers is perpendicular to an axial direction of the resonant through hole, shielding and leakage prevention can also be implemented, miniaturization can be implemented, and a shielding cover is omitted to prevent a problem of unstable welding.

In a possible implementation, a plurality of parallel resonator single-stepped holes and multi-stepped holes provided in the dielectric block may be flexibly used in a staggered manner.

In a possible implementation, at least one coupling hole is provided between two adjacent resonant through holes, the coupling hole is a metalized through hole, and the coupling hole is configured to tune a coupling between the two adjacent resonant through holes.

In a possible implementation, the coupling hole is parallel to the resonant through hole.

In a possible implementation, the dielectric filter includes at least three resonant through holes, and the at least three resonant through holes are arranged in a staggered manner.

According to a third aspect, this application further provides a communications device. The communications device includes the dielectric filter disclosed in any one of the possible implementations of the first aspect and the second aspect.

Because the communications device provided in the embodiments of this application uses the dielectric filter disclosed in any one of the possible implementations of the first aspect, the second aspect, or the third aspect, signal energy leakage in the filter and interference from an external signal can be prevented, thereby improving a background noise suppression capability. In addition, the dielectric filter avoids problems that may occur during welding, thereby guaranteeing performance of the dielectric filter and the communications device including the dielectric filter. In addition, miniaturization of the filter can be implemented so that an overall volume of the communications device can be smaller.

DESCRIPTION OF EMBODIMENTS

The embodiments of this application relate to a dielectric filter and a communications device. The following briefly describes concepts involved in the embodiments of this application.

A transverse electromagnetic mode is a wave mode in which both an electric field and a magnetic field are distributed in a cross section perpendicular to a propagation direction of an electromagnetic wave, and there is no electric field or magnetic field component in the propagation direction of the electromagnetic wave.

A dielectric filter is a filter designed and made by using features of a dielectric (for example, ceramic) material such as a low loss, a high dielectric constant, a small frequency temperature coefficient, a small thermal expansion coefficient, and a high power tolerance, and may be composed of several long resonators in a trapezoid line in multi-level series or parallel.

Background noise is also referred to as background noise, and generally refers to total noise except for useful signals in a communications system.

A resonance is a phenomenon that when an excitation frequency in a circuit is equal to a natural frequency of the circuit, an amplitude of an electromagnetic oscillation of the circuit reaches the peak.

A via is also referred to as a metalized hole. The via is a hole that is provided on a dielectric and passes through two opposite surfaces of the dielectric, and an inner wall of the hole is metalized so that a coupling effect can be generated with another metalized hole.

Figure 1:
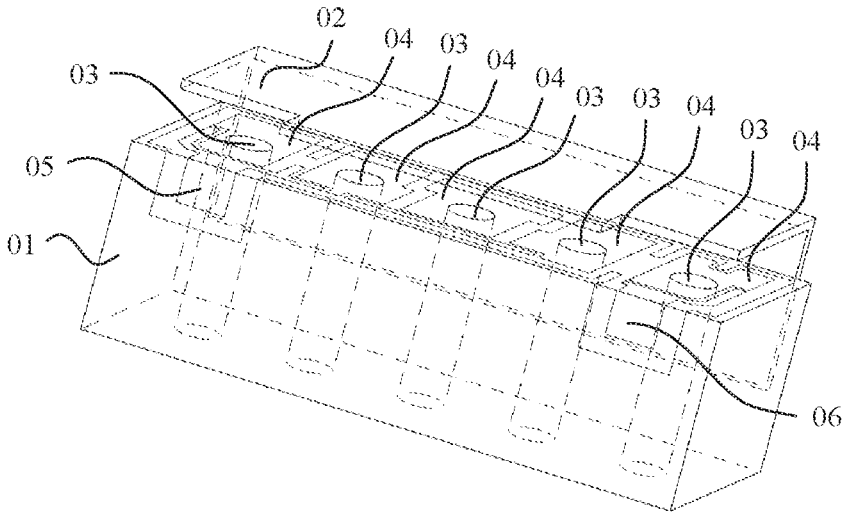
FIG. 1 is a schematic structural diagram of a TEM dielectric filter.
Figure 2:
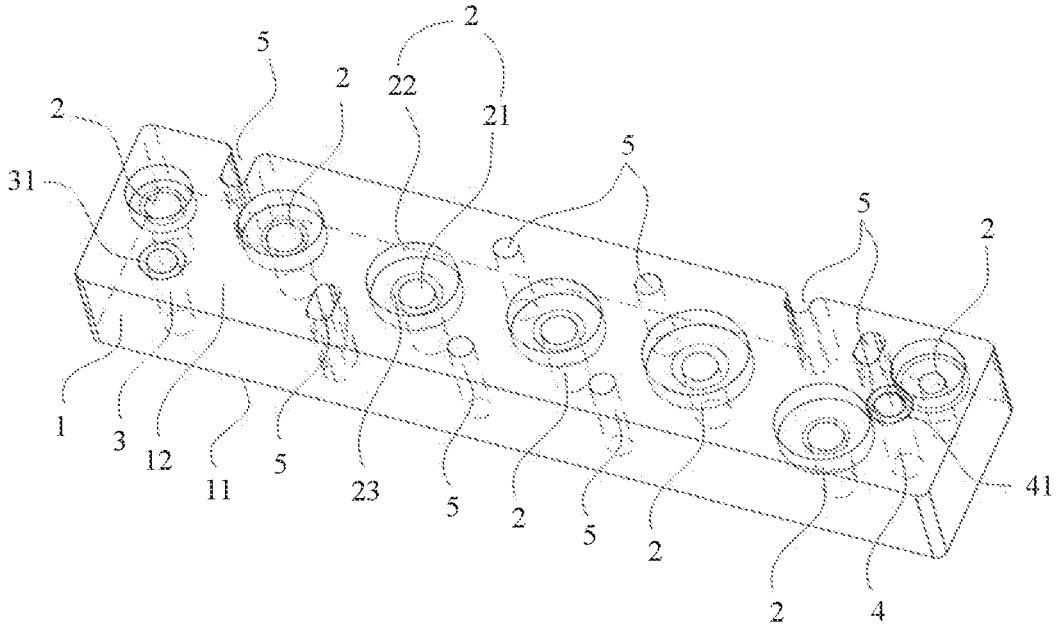
FIG. 2 is a schematic structural diagram of a dielectric filter according to an embodiment of this application.
Figure 3:
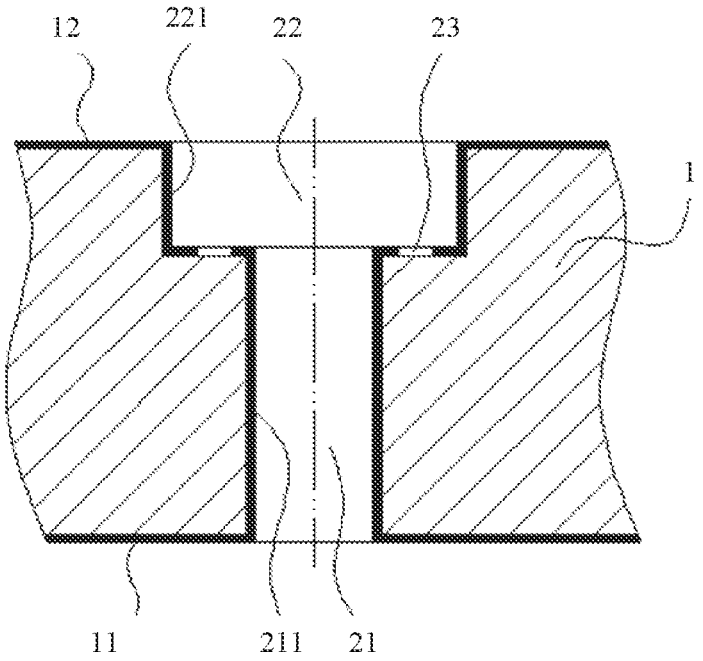
FIG. 3 is a partial sectional view of a resonant through hole of a dielectric filter according to an embodiment of this application.

As shown in FIG. 2, an embodiment of this application provides a dielectric filter, including a dielectric block 1. At least two resonant through holes 2 that are parallel to each other are provided in the dielectric block 1, the resonant through hole 2 is a stepped hole, and the stepped hole includes a stepped small hole 21 and a stepped large hole 22 that are arranged coaxially and that are in communication. The stepped small hole 21 passes through a first surface 11 of the dielectric block 1, the stepped large hole 22 passes through a second surface 12 of the dielectric block 1, and a stepped surface is formed between the stepped large hole 22 and the stepped small hole 21. As shown in FIG. 3, the surfaces of the dielectric block 1 are covered with conductor layers, and the conductor layers cover the surfaces of the dielectric block 1 and inner walls of the stepped large hole 22 and the stepped small hole 21. A conductor layer 211 of the inner wall of the stepped small hole is short-circuited with a conductor layer of the first surface 11, and a conductor layer 221 of the inner wall of the stepped large hole is short-circuited with a conductor layer of the second surface 12. A loop gap 23 not covered with the conductor layer is provided on the stepped surface between the stepped large hole 22 and the stepped small hole 21, and the loop gap 23 is arranged around the stepped small hole 21 so that an open circuit is formed between the conductor layer 211 of the inner wall of the stepped small hole and the conductor layer 221 of the inner wall of the stepped large hole.

According to the dielectric filter provided in this embodiment of this application, a plurality of resonant through holes 2 that are parallel to each other are provided in the dielectric block 1, the resonant through hole 2 is a stepped hole, and the stepped hole includes a stepped large hole 22 and a stepped small hole 21 that are arranged coaxially and that are in communication. The surfaces of the dielectric block 1 are covered with conductor layers, and the conductor layers cover the surfaces of the dielectric block 1 and inner walls of the stepped large hole 22 and the stepped small hole 21. After being input into the filter, an electromagnetic wave signal is transmitted through resonant coupling between a plurality of stepped small holes 21. The loop gap 23 is arranged around the stepped small hole 21 so that an open circuit is formed between the conductor layer 211 of the inner wall of the stepped small hole and the conductor layer 221 of the inner wall of the stepped large hole. Therefore, a capacitance may be formed between the conductor layer 221 of the inner wall of the stepped small hole and the conductor layer 211 of the inner wall of the stepped small hole. The introduced capacitance can lower a resonant frequency of the filter so that a volume of the filter can be made smaller. In addition, a direction of an electric field formed between the conductor layer 221 of the inner wall of the stepped small hole and the conductor layer 211 of the inner wall of the stepped small hole is perpendicular to an axial direction of the resonant through hole 2, and a resonant direction between the conductor layer 221 of the inner wall of the stepped large hole and the conductor layer 211 of the inner wall of the stepped small hole is also perpendicular to the axial direction of the resonant through hole 2 so that the electromagnetic signal is not easily leaked from the loop gap 23. In addition, because all surfaces of the dielectric block 1 are provided with the conductor layer, the conductor layer can effectively shield a signal, to prevent signal energy leakage and interference from an external signal, thereby improving a background noise suppression capability. In this way, the dielectric filter in this application can prevent signal leakage and implement miniaturization of the filter, and a shielding cover is omitted to prevent a problem of unstable welding.

It should be noted that the dielectric block 1 may also be referred to as a dielectric block, and charged particles of the dielectric are tightly bound by internal forces of atoms and molecules or by forces between molecules. Therefore, charges of these particles are bound charges. Under the action of an external electric field, these charges can move only within a microscopic range, to produce polarization. A material of the dielectric block 1 may be ceramic, glass, resin, polymer, or the like. A material of the conductor layer may be a metal material, for example, silver or copper.

The resonant through hole 2 may be a round hole, a square hole, an elliptical hole, or the like. This is not limited herein. In addition, parameters such as the quantity, diameter, and length of the resonant through holes 2, and the center distance between two adjacent resonant through holes 2 may be designed and adjusted as required.

Figure 4:
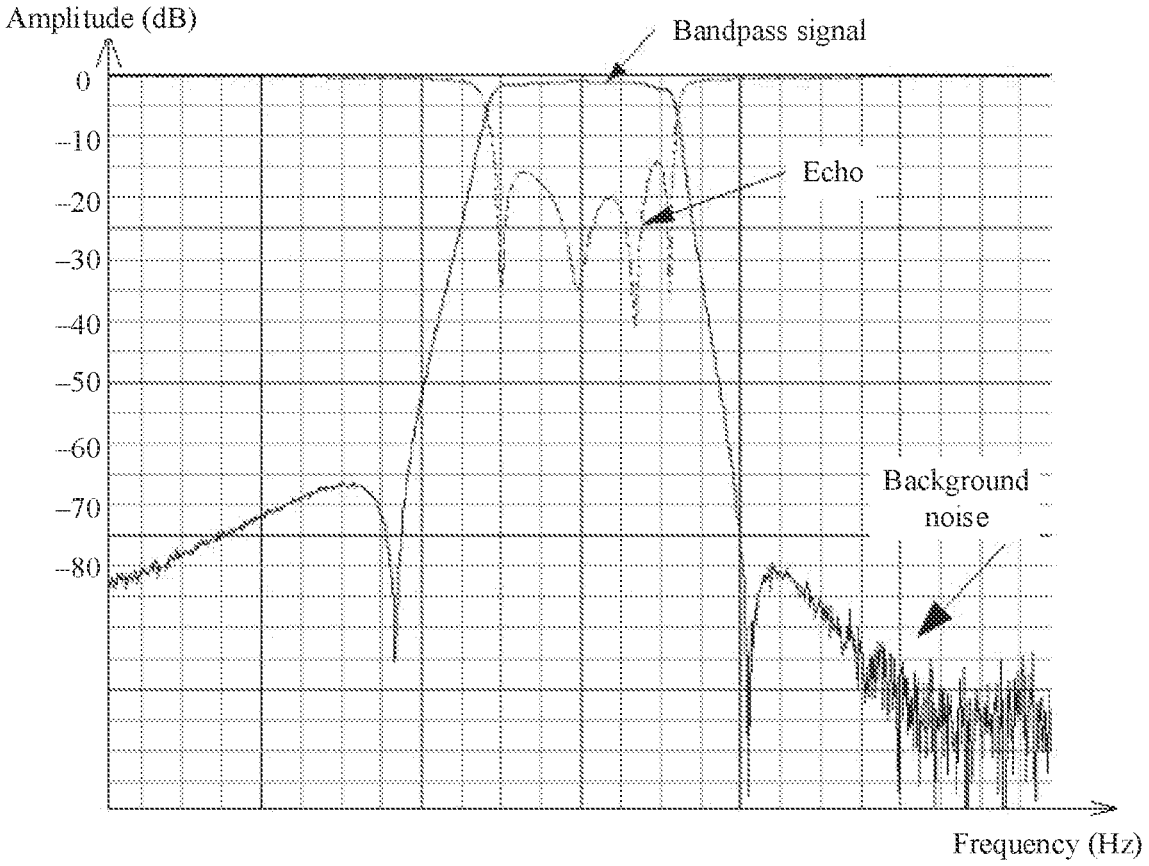
FIG. 4 is an experimental result diagram of a background noise suppression level of a dielectric filter according to an embodiment of this application.
Figure 5:
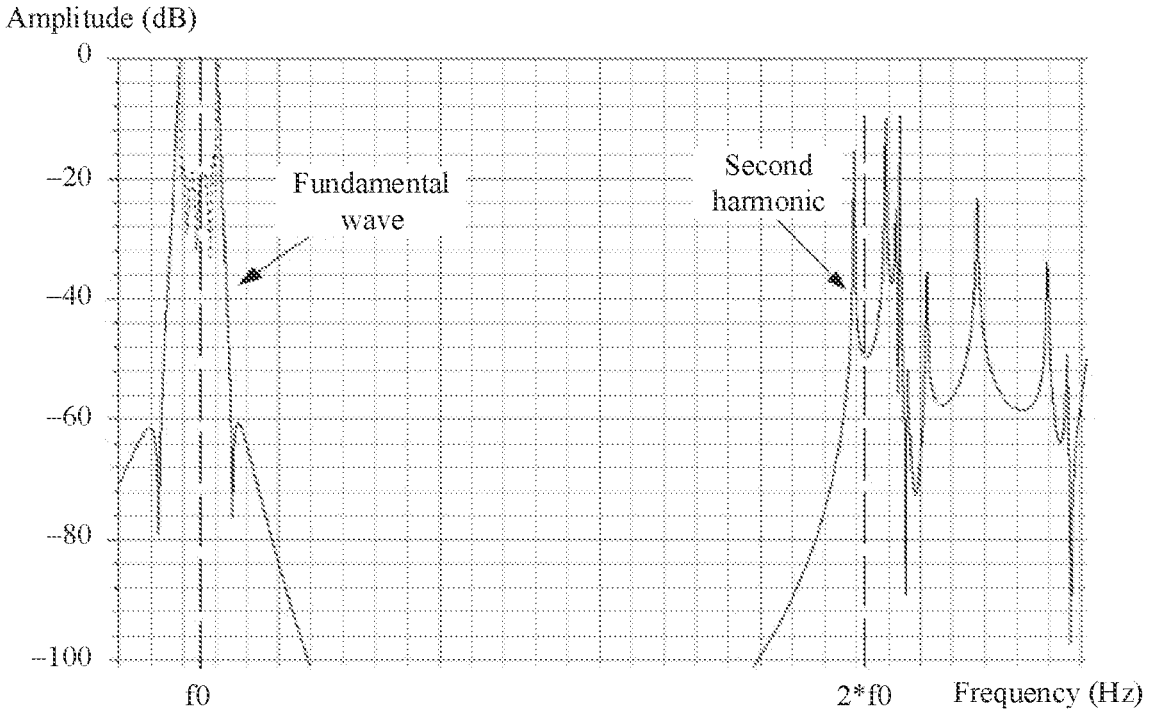
FIG. 5 is a schematic diagram of a fundamental wave curve and a second harmonic curve of a dielectric filter according to an embodiment of this application.

The following describes the filtering effect of the dielectric filter in this embodiment of this application with reference to experimental data. An experiment on a background noise suppression level is performed on the dielectric filter shown in FIG. 2. The dielectric filter shown in FIG. 2 includes seven resonant through holes 2. The seven resonant through holes 2 are arranged in a single row, and a coupling and a resonant frequency are tuned by using a coupling hole 5 between two adjacent resonant through holes 2. An experimental result of the background noise suppression level is shown in FIG. 4. It can be seen from FIG. 4 that, assuming that an amplitude of a bandpass signal is 0 dB, an amplitude of background noise (namely, a curve corresponding to the right side of frequency f0) is lowered below −80 dB, but an amplitude of background noise of an existing filter can only be lowered below −60 dB. Therefore, the dielectric filter provided in this embodiment of this application effectively enhances a background noise suppression capability of the dielectric filter. In addition, FIG. 5 is a diagram of an experimental result of a second harmonic suppression level of a dielectric filter according to an embodiment of this application. A curve on the left in FIG. 5 is a fundamental wave curve, and a curve on the right in FIG. 5 is a second harmonic curve. It can be seen from FIG. 5 that, the second harmonic appears at a position about twice the frequency of the fundamental wave. However, the second harmonic of the existing filter appears at a position about 1.7 times the frequency of the fundamental wave. Therefore, the dielectric filter in this application can make a frequency at which the second harmonic appears relatively far from the frequency of the fundamental wave, thereby effectively relieving the pressure of suppressing harmonics in an entire communications system.

During making of the loop gap 23, a metal layer that completely covers the stepped surface may be first formed on the stepped surface between the stepped large hole 22 and the stepped small hole 21, and then a part of the metal layer around the stepped small hole 21 may be partially removed to form a ring groove. The ring groove is the loop gap 23. In another possible implementation, a metal ring may be directly made on the stepped surface so that a loop gap is reserved between the metal ring and the stepped small hole 21. The loop gap is the loop gap 23.

Specifically, because the loop gap 23 is provided on the stepped surface, an outer diameter of the loop gap 23 is less than or equal to an inner diameter of the stepped large hole 22, and an inner diameter of the loop gap 23 is greater than or equal to an inner diameter of the stepped small hole 21. In this way, the inner diameter and the outer diameter of the loop gap can be made according to an actual requirement, so that the loop gap does not exceed a range of the stepped surface, thereby facilitating processing and making of the loop gap 23. A difference between the outer diameter and the inner diameter of the loop gap 23 may be selected to be less than or equal to 1 millimeter. In this way, it can be ensured that an open circuit is formed between the conductor layer 211 of the inner wall of the stepped small hole and the conductor layer 221 of the inner wall of the stepped large hole, and an area of the loop gap 23 may be smaller so that signal energy is not easily leaked from the loop gap 23.

To implement signal input and output, as shown in FIG. 2, an input via 3 and an output via 4 are further provided in the dielectric block 1, and both the input via 3 and the output via 4 are metalized through holes. In this way, a signal can be input and output through the input via 3 and the output via 4, and because metal conductors of the input via 3 and the output via 4 are both inside the holes, signal energy leakage caused by an exposed transmission line can be avoided.

It should be noted that the input via 3 and the output via 4 shown in FIG. 2 are merely examples for describing a possible implementation function of the input via 3 and the output via 4. In another possible implementation, the input via 3 may alternatively be used to output a signal, and the output via 4 may alternatively be used to input a signal.

The input via 3 and the output via 4 may be a round hole, a square hole, an elliptical hole, or the like. This is not limited herein. In addition, parameters such as the diameter, length, and center distance of the input via 3 and the output via 4 can be designed and adjusted as required.

Figure 6:
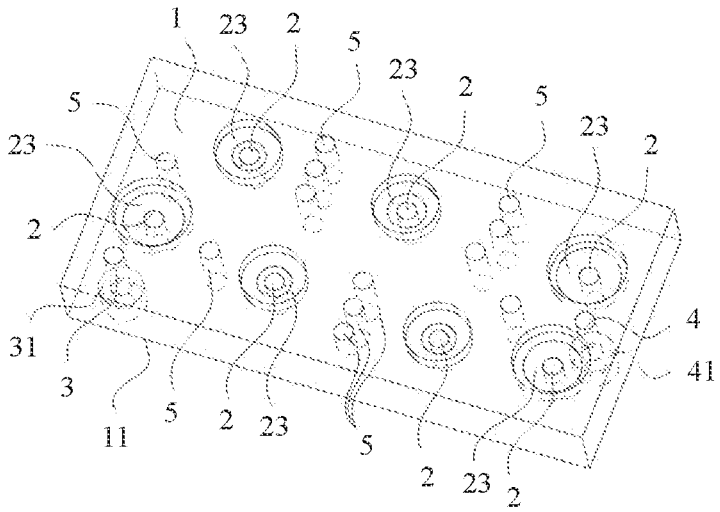
FIG. 6 is a schematic structural diagram of another embodiment of a dielectric filter according to an embodiment of this application.

To implement connection between the dielectric filter and another electronic component (for example, a circuit board), pads may be disposed at edges of one end of the input via 3 and the output via 4. In a possible implementation solution, as shown in FIG. 6, an input pad 31 and an output pad 41 may be formed on the first surface 11 of the dielectric block 1. The first surface 11 of the dielectric block 1 may be connected to another electronic component during installation. In another possible implementation solution, as shown in FIG. 2, an input pad 31 and an output pad 41 may alternatively be formed on the second surface 12 of the dielectric block 1. The second surface 12 of the dielectric block 1 may be connected to another electronic component during installation. The input pad and the output pad are disposed on a same surface of the dielectric block so that both the input pad and the output pad of the dielectric filter are connected to a same device, and input and output signals of the dielectric filter are transmitted to the same device. For example, when the input pad and the output pad are disposed on the same surface of the dielectric block 1, the dielectric filter may be attached to a printed circuit board (PCB), and all signals are transmitted on the PCB. In addition, the first surface 11 or the second surface 12 of the dielectric block 1 may be selected to be electrically connected to the PCB according to different installation requirements so that installation selections of the filter are more diversified.

In addition, the input pad 31 and the output pad 41 may alternatively be separately disposed on different surfaces of the dielectric block 1. For example, the input pad 31 is disposed on the first surface 11 of the dielectric block 1, and the output pad 41 may be disposed on the second surface 12 of the dielectric block 1. For another example, the input pad 31 may be disposed on the second surface 12 of the dielectric block 1, and the output pad 41 may be disposed on the first surface 11 of the dielectric block 1. The input pad 31 and the output pad 41 are disposed on different surfaces of the dielectric block 1 so that transmission of input and output signals in different positions can be facilitated. For example, when the input pad 31 is disposed on the first surface 11 of the dielectric block 1, and the output pad 41 may be disposed on the second surface 12 of the dielectric block 1, the first surface 11 of the dielectric block 1 may be attached to the PCB and connected to the PCB by using the input pad 31, and the output pad 41 of the second surface 12 of the dielectric block 1 may be connected to another electronic component (such as an antenna, a signal line, or another PCB) other than the PCB. In this case, it is convenient to transmit a signal from the PCB to another electronic component (such as an antenna, a signal line, or another PCB).

In addition, the filter may be connected to another electronic component by using a connector (for example, a pin). Specifically, the pin may be inserted into the input via 3 and the output via 4 so that the pin is electrically connected to a metal layer of inner walls of the input via 3 and the output via 4.

Optionally, the input or output manner of the dielectric filter provided in this embodiment of this application may alternatively be implemented in another manner based on a requirement. For example, signal input and/or output may be implemented only by using the vias, or signal input and/or output may be implemented only by using the pads, or the foregoing two manners are used in combination. Input and output positions of signals may alternatively be set at different positions of the dielectric block as required, and are not limited to the first surface and the second surface.

To tune a coupling between two adjacent resonant through holes 2, a spacing between the two adjacent resonant through holes 2 may be changed. When the coupling needs to be increased, the spacing between the two adjacent resonant through holes 2 may be shortened, and when the coupling needs to be reduced, the spacing between the two adjacent resonant through holes 2 may be increased. However, increasing the spacing between the two adjacent resonant through holes 2 increases the volume of the filter. Therefore, to implement miniaturization of the filter, as shown in FIG. 2 and FIG. 6, at least one coupling hole 5 may be provided between two adjacent resonant through holes 2, and the coupling hole 5 is a metalized through hole. The coupling may be tuned by adjusting an aperture of the coupling hole 5 and adjusting a position of the coupling hole 5 relative to the two resonant through holes 2. In this way, the coupling between the two adjacent resonant through holes 2 can be reduced without changing the volume of the filter. Specifically, as shown in FIG. 2, the coupling hole 5 may be arranged in parallel with the resonant through hole 2, thereby facilitating coupling between the coupling hole 5 and the resonant through hole 2. In addition, there are many options for a cross-sectional shape of the coupling hole 5. For example, the coupling hole 5 may be a round hole, or may be a flat hole, an elliptical hole, or the like. A larger size of the coupling hole 5 indicates a smaller coupling, and a shorter distance between the coupling hole 5 and a central line of two adjacent resonant through holes 2 indicates a smaller coupling. The size, shape, and position of the coupling hole 5 may be set according to an actual required coupling.

The dielectric filter may include at least three resonant through holes 2, and the three resonant through holes 2 are arranged in a staggered manner. The staggered arrangement means that the three resonant through holes 2 are not arranged in one straight line, or means that the three resonant through holes 2 are arranged in triangle. In this way, one resonant through hole 2 can resonantly propagate to two or more different directions, thereby increasing a degree of freedom in designing the dielectric filter, to more accurately design performance parameters of the dielectric filter. In an arrangement manner, as shown in FIG. 6, the plurality of resonant through holes 2 are arranged in two rows as a whole, and the two adjacent rows of resonant through holes 2 are arranged in a staggered manner. In this way, the length of the filter can be shortened.

In a possible implementation, the resonant through hole provided in the dielectric block may include a stepped hole 1 and a stepped hole 2 that are arranged coaxially and that are in communication. The stepped hole 1 passes through a first surface of the dielectric block, and the stepped hole 2 passes through a second surface of the dielectric block. An aperture of the stepped hole 1 is different from an aperture of the stepped hole 2, and a first stepped surface is formed between the stepped hole 1 and the stepped hole 2. The stepped hole 1 may include a stepped hole 3 and a stepped hole 4 that are arranged coaxially and that are in communication. The stepped hole 3 passes through the first surface of the dielectric block, the stepped hole 4 is in communication with the stepped hole 2, and a second stepped surface is formed between the stepped hole 3 and the stepped hole 4. An aperture of the stepped hole 3 is different from an aperture of the stepped hole 4.

The stepped hole 2, the stepped hole 3, and the stepped hole 4 may form a resonant through hole with a double-stepped surface. For example, the following describes various possible opening forms of the resonant through hole with the double-stepped surface. For example, according to the apertures, the hole with the largest aperture among the stepped hole 2, the stepped hole 3, and the stepped hole 4 may be referred to as a stepped large hole, the hole with the smallest aperture is referred to as a stepped small hole, and the hole with the aperture between the two is referred to as a stepped medium hole.

Figure 7:
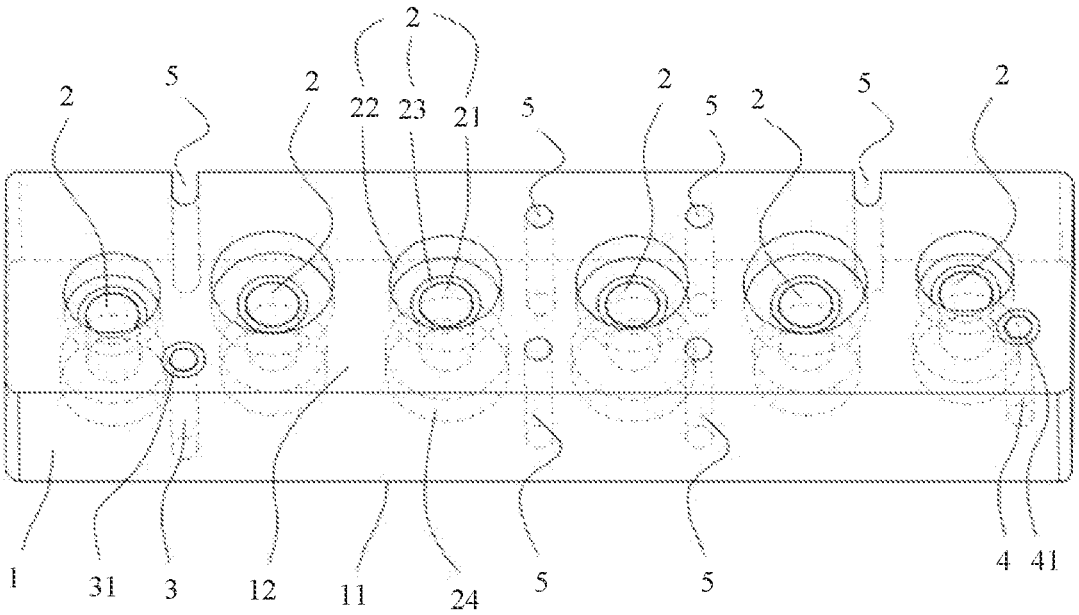
FIG. 7 is a schematic structural diagram of another embodiment of a dielectric filter according to an embodiment of this application.
Figure 8:
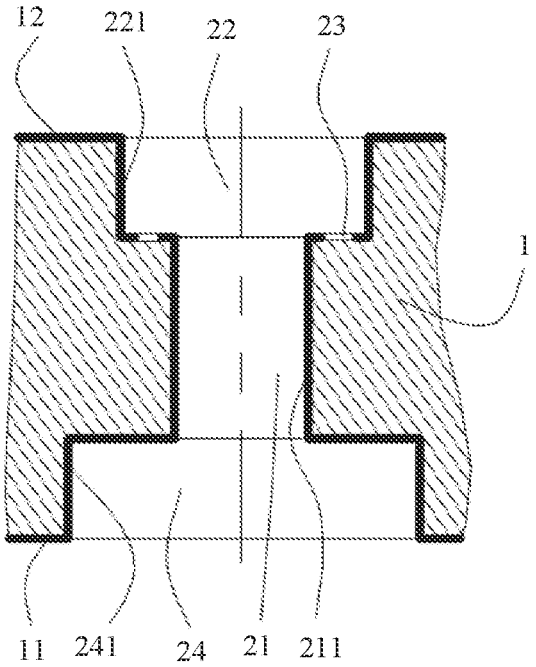
FIG. 8 is a partial sectional view of another resonant through hole of a dielectric filter according to an embodiment of this application.

When required, FIG. 7 shows a variant of the resonant through hole of FIG. 2. As shown in FIG. 7, the resonant through hole 2 may be divided into three segments. FIG. 8 shows a section of the resonant through hole of FIG. 7. It is composed of an upper step and a lower step, where a stepped large hole 24 passes through the first surface 11, a stepped medium hole 22 passes through the second surface 12, and a stepped small hole 21 in the middle connects the stepped large hole and the stepped medium hole. A conductor layer 241 of an inner wall of the stepped large hole is short-circuited with a conductor layer 211 of the stepped small hole, to form a short-circuit surface, and a conductor layer 221 of an inner wall of the stepped medium hole is separated from a conductor layer 211 of the stepped small hole by a loop structure 23 without a conductor layer to form an open circuit. In this way, a capacitance may still be formed between the conductor layer 221 and the conductor layer 211 to reduce a volume and omit a shielding cover.

Figure 9:
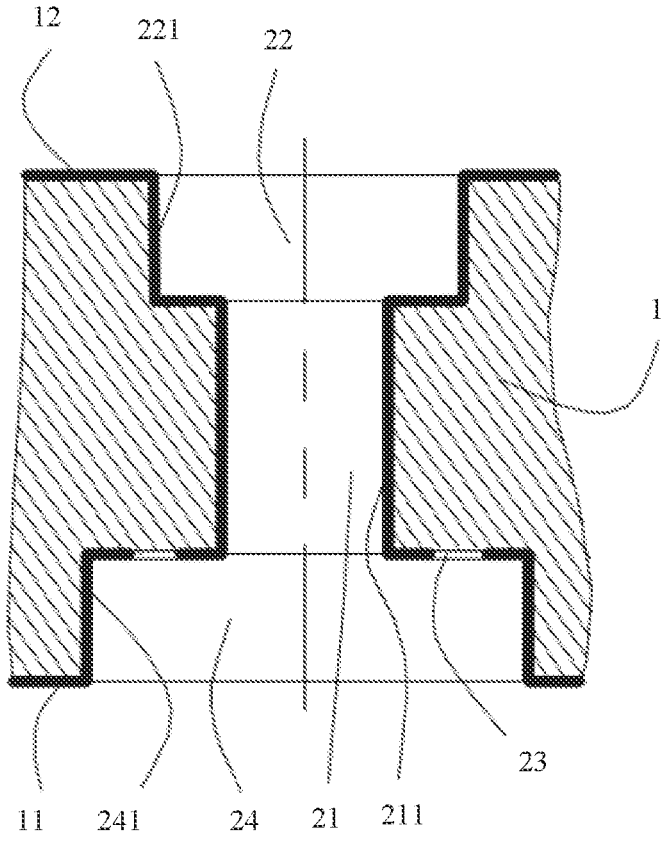
FIG. 9 is a partial sectional view of another resonant through hole of a dielectric filter according to an embodiment of this application.

When required, FIG. 9 shows another form of the resonant through hole. A stepped large hole 24 passes through the first surface 11, a stepped medium hole 22 passes through the second surface 12, and a stepped small hole 21 in the middle connects the stepped large hole and the stepped medium hole. A conductor layer 221 of an inner wall of the stepped medium hole is short-circuited with a conductor layer 221 of the stepped small hole to form a short-circuit surface. A conductor layer 241 of an inner wall of the stepped large hole is separated from the conductor layer 221 of the stepped small hole by a loop structure 23 without a conductor layer, to form an open circuit. In this way, a capacitance may be formed between the conductor layer 241 and the conductor layer 221 to reduce a volume and omit a shielding cover.

Figure 10:
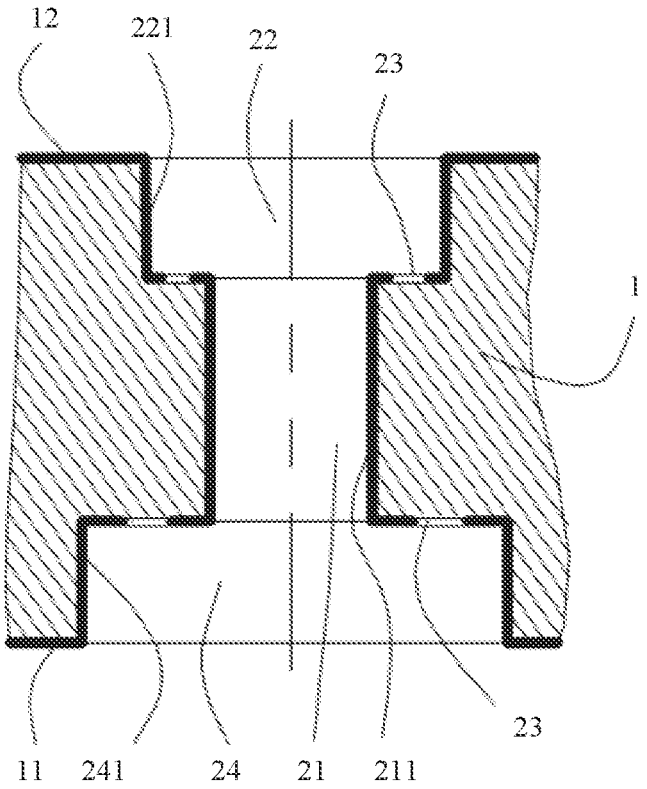
FIG. 10 is a partial sectional view of another resonant through hole of a dielectric filter according to an embodiment of this application.

When required, FIG. 10 shows another form of the resonant through hole. A stepped large hole 24 passes through the first surface 11, a stepped medium hole 22 passes through the second surface 12, and a stepped small hole 21 in the middle connects the stepped large hole and the stepped medium hole. A conductor layer 221 of an inner wall of the stepped medium hole and a conductor layer 241 of an inner wall of the stepped large hole are separated by a loop structure 23 without a conductor layer to form an open circuit. In this way, a capacitance may be formed between the conductor layer 221 and a conductor layer 211 and between the conductor layer 241 and the conductor layer 211 to reduce a volume and omit a shielding cover.

Figure 11:
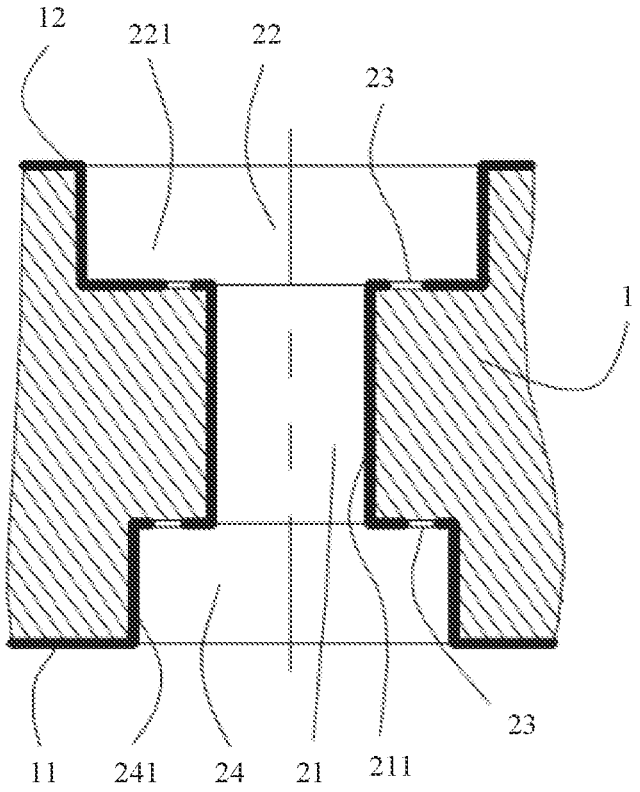
FIG. 11 is a partial sectional view of another resonant through hole of a dielectric filter according to an embodiment of this application.

When required, FIG. 11 shows another form of the resonant through hole. A stepped medium hole 24 passes through the first surface 11, a stepped large hole 22 passes through the second surface 12, and a stepped small hole 21 in the middle connects the stepped medium hole and the stepped small hole. A conductor layer 241 of an inner wall of the stepped medium hole and a conductor layer 221 of an inner wall of the stepped large hole are separated by a loop structure 23 without a conductor layer to form an open circuit. In this way, a capacitance may be formed between the conductor layer 221 and a conductor layer 211 and between the conductor layer 241 and the conductor layer 211 to reduce a volume and omit a shielding cover.

Figure 12:
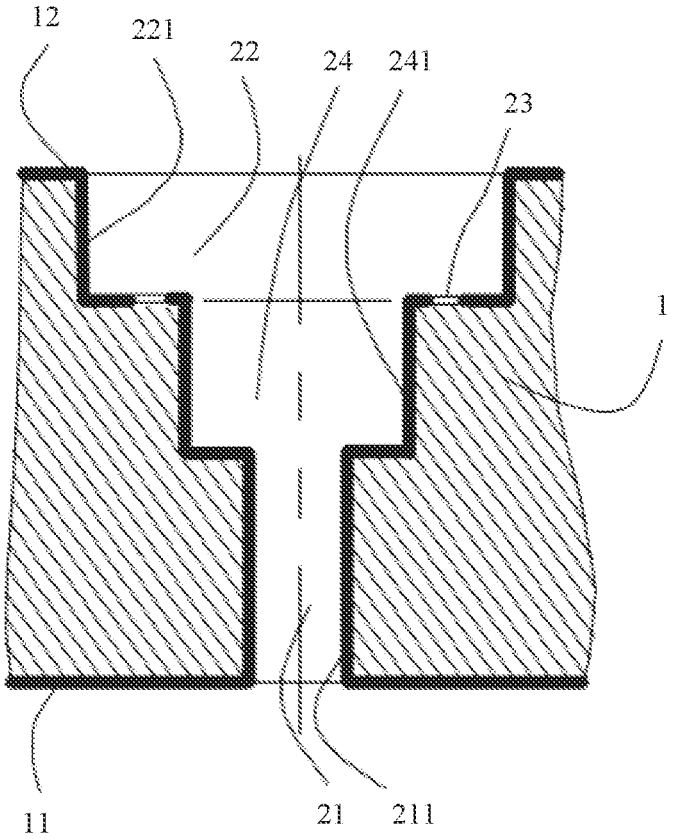
FIG. 12 is a partial sectional view of another resonant through hole of a dielectric filter according to an embodiment of this application.

When required, FIG. 12 shows another form of the resonant through hole. A stepped small hole 21 passes through the first surface 11, a stepped large hole 22 passes through the second surface 12, and a stepped medium hole 24 is in the middle. A conductor laver 221 of an inner wall of the stepped large hole and a conductor layer 241 of the stepped medium hole are separated by a loop structure 23 without a conductor laver to form an open circuit. In this way, a capacitance may be formed between the conductor layer 221 and the conductor layer 241, to reduce a volume and omit a shielding cover.

Figure 13:
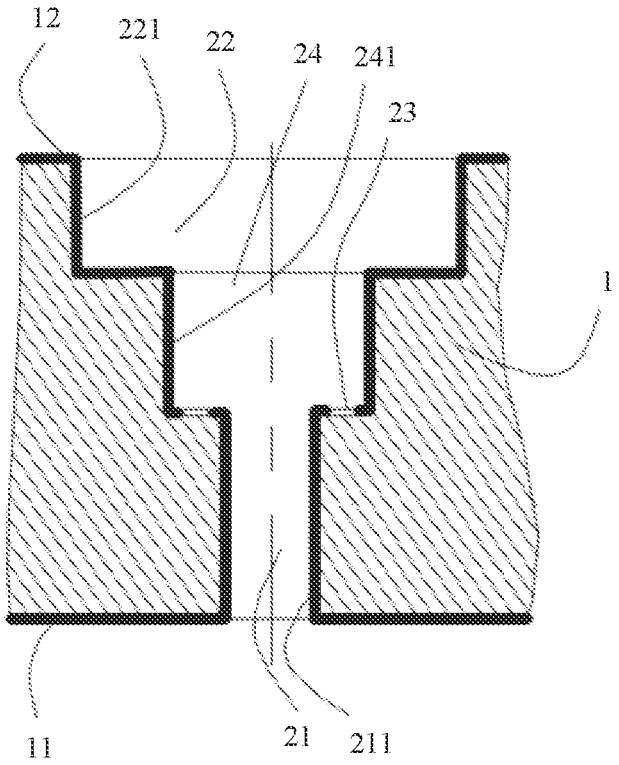
FIG. 13 is a partial sectional view of another resonant through hole of a dielectric filter according to an embodiment of this application.

When required, FIG. 13 shows another form of the resonant through hole. A stepped small hole 21 passes through the first surface 11, a stepped large hole 22 passes through the second surface 12, and a stepped medium hole 24 is in the middle. A conductor layer 241 of an inner wall of the stepped medium hole and a conductor layer 211 of the stepped small hole are separated by a loop structure 23 without a conductor layer to form an open circuit. In this way, a capacitance may be formed between the conductor layer 211 and the conductor layer 241 to reduce a volume and omit a shielding cover.

Figure 14:
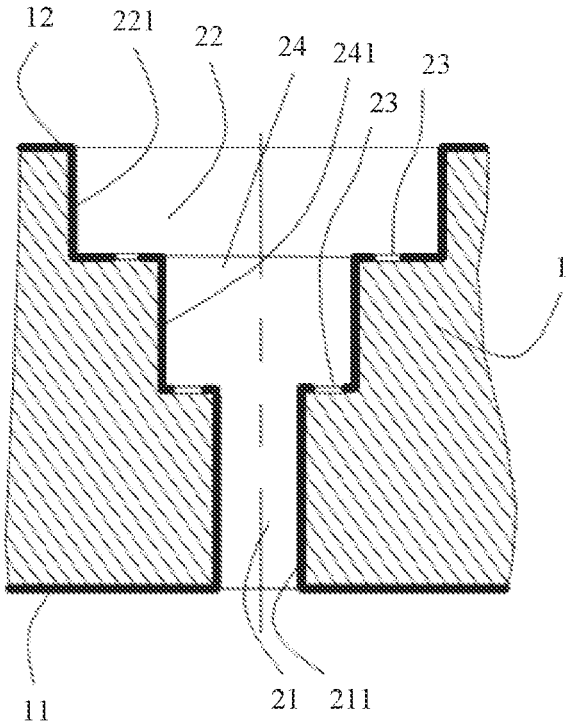
FIG. 14 is a partial sectional view of another resonant through hole of a dielectric filter according to an embodiment of this application.

When required, FIG. 14 shows another form of the resonant through hole. A stepped small hole 21 passes through the first surface 11, a stepped large hole 22 passes through the second surface 12, and a stepped medium hole 24 is in the middle. A conductor layer 241 of the stepped medium hole is separated from a conductor layer 221 of the stepped large hole and a conductor layer 211 of the stepped small hole by a loop structure 23, to form an open circuit. In this way, a capacitance may be formed between the conductor layer 221 and the conductor layer 241 and between the conductor layer 211 and the conductor layer 241 to reduce a volume and omit a shielding cover.

Figure 15:
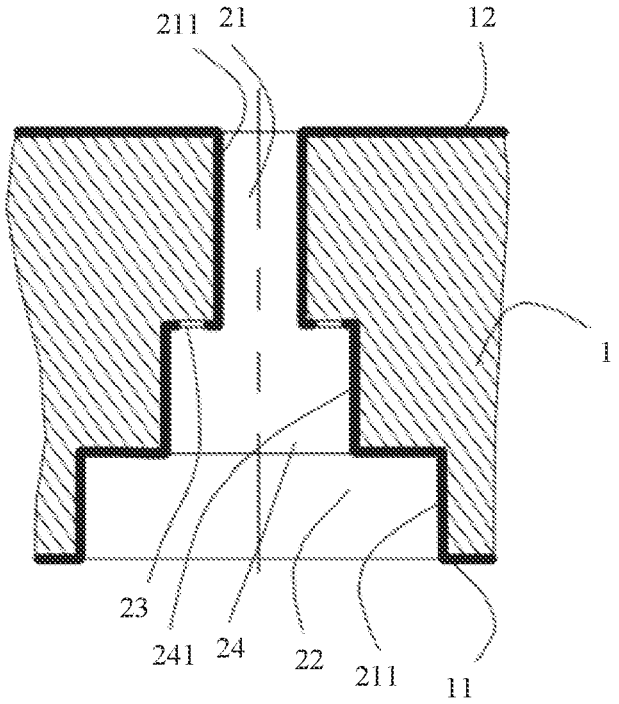
FIG. 15 is a partial sectional view of another resonant through hole of a dielectric filter according to an embodiment of this application.

When required, FIG. 15 shows another form of the resonant through hole. A stepped large hole 22 passes through the first surface 11, a stepped small hole 21 passes through the second surface 12, and a stepped medium hole 24 is in the middle. A conductor layer 241 of the stepped medium hole and a conductor layer 211 of the stepped small hole are separated by a loop structure 23 without a conductor layer to form an open circuit. In this way, a capacitance may be formed between the conductor layer 211 and the conductor layer 241, to reduce a volume and omit a shielding cover.

Figure 16:
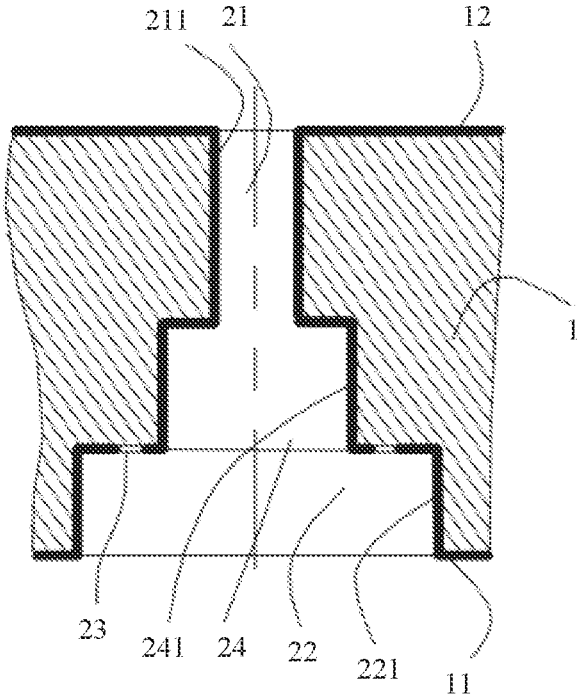
FIG. 16 is a partial sectional view of another resonant through hole of a dielectric filter according to an embodiment of this application.

When required, FIG. 16 shows another form of the resonant through hole. A stepped large hole 22 passes through the first surface 11, a stepped small hole 21 passes through the second surface 12, and a stepped medium hole 24 is in the middle. A conductor layer 241 of the stepped medium hole and a conductor layer 221 of the stepped large hole are separated by a loop structure 23 without a conductor layer, to form an open circuit. In this way, a capacitance may be formed between the conductor layer 221 and the conductor layer 241, to reduce a volume and omit a shielding cover.

Specifically, because the loop gap 23 is provided on the first stepped surface, an outer diameter of the loop gap 23 is less than or equal to an aperture of the stepped large hole 22, and an inner diameter of the loop gap 23 is greater than or equal to an aperture of the stepped medium hole 24. Therefore, the inner diameter and the outer diameter of the loop gap can be made according to an actual requirement so that the loop gap does not exceed a range of the first stepped surface, thereby facilitating processing and making of the loop gap 23. A difference between the outer diameter and the inner diameter of the loop gap 23 may be selected to be less than or equal to 1 millimeter.

It should be noted that the resonant through hole 2 of the filter shown in FIG. 7 may be designed by using any combination of the foregoing resonant through holes.

In a possible implementation, a plurality of parallel resonant through hole stepped holes provided in the dielectric block are not limited to the double-stepped hole and both a three-stepped hole and a four-stepped hole are available. A capacitance can be formed between the conductor layers provided that a loop gap not covered with the conductor layer is provided on the at least one stepped surface. Shielding and leakage prevention can also be implemented to reduce a volume and omit a shielding cover.

In a possible implementation, a plurality of parallel resonator single-stepped holes and multi-stepped holes provided in the dielectric block may be flexibly used in a staggered manner.

Figure 17:
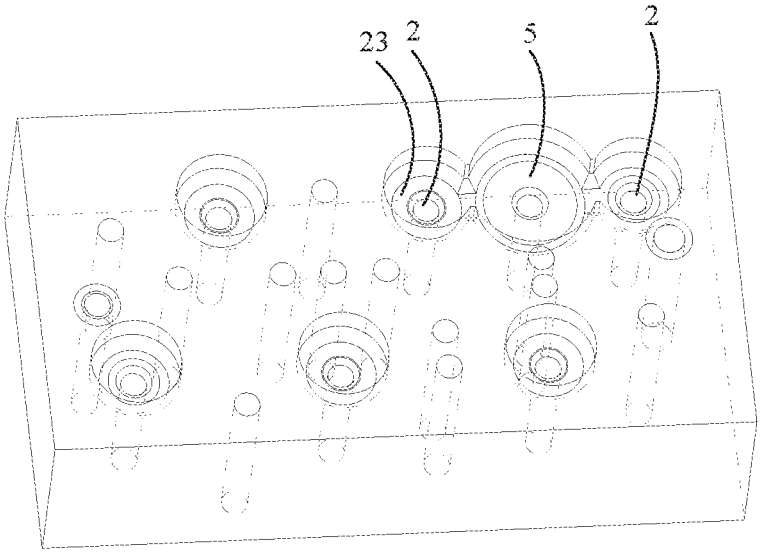
FIG. 17 is a schematic structural diagram of another embodiment of a dielectric filter according to an embodiment of this application.

When required, as shown in FIG. 17, an embodiment of this application further provides an opening form of another coupling hole in the dielectric filter. The resonant through hole in any form may also be used as a coupling hole, for example, the coupling hole 5 in FIG. 17. A through hole form of the coupling hole 5 is the same as that of the resonant through hole 2, but the coupling hole 5 is provided between two adjacent resonant through holes 2. As a coupling hole, the resonant through hole can tune a coupling by adjusting an aperture of the coupling hole 5 and adjusting a position of the coupling hole 5 relative to the two resonant through holes. The loop structure 23 without a conductor layer shown in FIG. 17 is a resonant hole open circuit surface.

According to another aspect, this application further provides a communications device. The communications device includes the dielectric filter disclosed in the embodiments of the present invention.

Because the communications device provided in this embodiment of this application uses the dielectric filter disclosed in this embodiment of the present invention, signal energy leakage in the filter and interference from an external signal can be prevented, thereby improving a background noise suppression capability. In addition, because the dielectric filter avoids problems that may occur during welding, performance of the dielectric filter and the communications device including the dielectric filter is guaranteed. In addition, miniaturization of the filter can be implemented so that an overall volume of the communications device can be smaller.

It should be noted that the communications device provided in this embodiment of this application may be a transceiver, a base station, a microwave communications device, a Wi-Fi communications device, or the like, or may be various types of terminal devices.

The foregoing descriptions are merely specific implementations of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A dielectric filter, comprising:

a dielectric block, wherein:

at least two resonant through holes that are parallel to each other are provided in the dielectric block, wherein each of the at least two resonant through holes is a stepped hole, wherein the stepped hole comprises a large stepped hole and a small stepped hole, wherein the large stepped hole is relatively larger than the small stepped hole, wherein the large stepped hole and the small stepped hole are arranged coaxially and are in communication, wherein the small stepped hole passes through a first surface of the dielectric block, wherein the large stepped hole passes through a second surface of the dielectric block, and wherein a stepped surface is formed between the large stepped hole and the small stepped hole; and the first surface, the second surface, and the stepped surface of the dielectric block as the surfaces of the dielectric block are covered with conductor layers, wherein the conductor layers cover the surfaces of the dielectric block and inner walls of the large stepped hole and the small stepped hole, wherein a conductor layer of an inner wall of the large stepped hole is short-circuited with a conductor layer of the second surface, wherein a conductor layer of an inner wall of the small stepped hole is short-circuited with a conductor layer of the first surface, wherein a loop gap not covered with the conductor layers is provided on the stepped surface, and wherein the loop gap is arranged around the small stepped hole.

2. The dielectric filter according to claim 1, wherein the dielectric block is further provided with an input via and an output via, and wherein both the input via and the output via are metalized through holes.

3. The dielectric filter according to claim 2, wherein an input pad connected to the input via and an output pad connected to the output via are disposed on the first surface.

4. The dielectric filter according to claim 2, wherein an input pad connected to the input via and an output pad connected to the output via are disposed on the second surface.

5. The dielectric filter according to claim 1, wherein an outer diameter of the loop gap is less than or equal to an inner diameter of the large stepped hole, and wherein an inner diameter of the loop gap is greater than or equal to an inner diameter of the small stepped hole.

6. The dielectric filter according to claim 1, wherein a difference between an outer diameter and an inner diameter of the loop gap is less than or equal to one millimeter.

7. The dielectric filter according to claim 1, wherein at least one coupling hole is provided between two adjacent resonant through holes, wherein the at least one coupling hole is a metalized through hole, and wherein the at least one coupling hole is configured to tune a coupling between the two adjacent resonant through holes.

8. The dielectric filter according to claim 7, wherein the at least one coupling hole is parallel to the at least two resonant through holes.

9. The dielectric filter according to claim 1, wherein the dielectric filter comprises at least three resonant through holes, and wherein the at least three resonant through holes are arranged in a staggered manner.

10. A dielectric filter, comprising:

a dielectric block, wherein:

at least two resonant through holes that are parallel to each other are provided in the dielectric block, wherein each of the at least two resonant through holes is a stepped hole, wherein the stepped hole comprises a first stepped hole and a second stepped hole, wherein the first stepped hole and the second stepped hole are arranged coaxially and are in communication, wherein the first stepped hole passes through a first surface of the dielectric block, wherein the second stepped hole passes through a second surface of the dielectric block, wherein a first stepped surface is formed between the first stepped hole and the second stepped hole, and wherein an aperture of the first stepped hole is different from an aperture of the second stepped hole; and the first surface, the second surface, and the first stepped surface of the dielectric block as the surfaces of the dielectric block are covered with conductor layers, wherein the conductor layers cover the surfaces of the dielectric block and inner walls of the first stepped hole and the second stepped hole, wherein a conductor layer of the inner wall of the second stepped hole is short-circuited with a conductor layer of the second surface, wherein a conductor layer of the inner wall of the first stepped hole is short-circuited with a conductor layer of the first surface, and wherein a loop gap not covered with the conductor layers is provided on the first stepped surface.

11. The dielectric filter according to claim 10, wherein the dielectric block is further provided with an input via and an output via, and wherein both the input via and the output via are metalized through holes.

12. The dielectric filter according to claim 11, wherein an input pad connected to the input via and an output pad connected to the output via are disposed on the first surface.

13. The dielectric filter according to claim 11, wherein an input pad connected to the input via and an output pad connected to the output via are disposed on the second surface.

14. The dielectric filter according to claim 10, wherein an outer diameter of the loop gap is between the aperture of the first stepped hole and the aperture of the second stepped hole, wherein an inner diameter of the loop gap is between the aperture of the first stepped hole and the aperture of the second stepped hole, and wherein the outer diameter of the loop gap is different from the inner diameter of the loop gap.

15. The dielectric filter according to claim 10, wherein a difference between an outer diameter and an inner diameter of the loop gap is less than or equal to one millimeter.

16. The dielectric filter according to claim 10, wherein the first stepped hole comprises:

a third stepped hole and a fourth stepped hole, wherein the third stepped hole and the fourth stepped hole are arranged coaxially and are in communication, wherein the third stepped hole passes through the first surface of the dielectric block, wherein the fourth stepped hole is in communication with the second stepped hole, wherein a second stepped surface is formed between the third stepped hole and the fourth stepped hole, and wherein an aperture of the third stepped hole is different from an aperture of the fourth stepped hole.

17. The dielectric filter according to claim 10, wherein at least one coupling hole is provided between two adjacent resonant through holes, wherein the at least one coupling hole is a metalized through hole, and wherein the at least one coupling hole is configured to tune a coupling between the two adjacent resonant through holes.

18. The dielectric filter according to claim 17, wherein the at least one coupling hole is parallel to the at least two resonant through holes.

19. The dielectric filter according to claim 10, wherein the dielectric filter comprises at least three resonant through holes, and wherein the at least three resonant through holes are arranged in a staggered manner.

20. A communications device, comprising:

a dielectric block, wherein:

at least two resonant through holes that are parallel to each other are provided in the dielectric block, wherein each of the at least two resonant through holes is a stepped hole, wherein the stepped hole comprises a large stepped hole and a small stepped hole, wherein the large stepped hole and the small stepped hole are arranged coaxially and are in communication, wherein the small stepped hole passes through a first surface of the dielectric block, wherein the large stepped hole passes through a second surface of the dielectric block, and wherein a stepped surface is formed between the large stepped hole and the small stepped hole; and the first surface, the second surface, and the stepped surface of the dielectric block as the surfaces of the dielectric block are covered with conductor layers, wherein the conductor layers cover the surfaces of the dielectric block and inner walls of the large stepped hole and the small stepped hole, wherein a conductor layer of an inner wall of the large stepped hole is short-circuited with a conductor layer of the second surface, wherein a conductor layer of an inner wall of the small stepped hole is short-circuited with a conductor layer of the first surface, wherein a loop gap not covered with the conductor layers is provided on the stepped surface, and wherein the loop gap is arranged around the small stepped hole.

* * * * *